United States Patent [19]

Auriemma

[11] 4,245,922

[45] Jan. 20, 1981

[54] TRAFFIC DELINEATOR POST

[76] Inventor: Robert S. Auriemma, Rte. #1, Box 104, Bethel, Pa. 19507

[21] Appl. No.: 26,014

[22] Filed: Apr. 2, 1979

[51] Int. Cl.[3] ..... E01F 9/00

[52] U.S. Cl. ..... 404/10; 40/612; 256/1

[58] Field of Search ..... 404/10; 116/63 R, 63 P; 40/612; 256/1

[56] References Cited

U.S. PATENT DOCUMENTS

| | | | |
|---|---|---|---|
| 3,371,647 | 3/1968 | Shopbell | 404/10 |
| 3,380,428 | 4/1968 | Abrams | 404/10 X |
| 3,502,007 | 3/1970 | Anderson | 404/10 |
| 3,709,112 | 1/1973 | Ebinger | 404/10 |
| 3,851,615 | 12/1974 | Grundvig | 116/63 R |
| 3,863,595 | 2/1975 | Barnett | 116/63 R |
| 4,004,545 | 1/1977 | O'Donnell | 116/63 P |
| 4,061,435 | 12/1977 | Schmanski | 404/10 |
| 4,084,914 | 4/1978 | Humphrey | 404/10 |
| 4,092,081 | 5/1978 | Schmanski | 404/10 |
| 4,111,581 | 9/1978 | Auriemma | 404/10 |
| 4,122,795 | 10/1978 | Doring | 116/63 R |

FOREIGN PATENT DOCUMENTS

| | | | |
|---|---|---|---|
| 1286060 | 1/1969 | Fed. Rep. of Germany | 404/10 |
| 2532541 | 12/1976 | Fed. Rep. of Germany | 404/10 |
| 1552818 | 12/1968 | France | 404/10 |

*Primary Examiner*—Nile C. Byers, Jr.
*Attorney, Agent, or Firm*—Thomas Hooker

[57] ABSTRACT

A rigid self-supporting highway delineator post having reflective material mounted at the upper end and a first flex area at a height above grade and a second flex area located immediately below the reflective material whereby the post is non-destructively bent down about the lower flex area when hit by a moving vehicle and may be bent about the upper flex area to facilitate removal and insertion of sheets of reflective material.

9 Claims, 8 Drawing Figures

TRAFFIC DELINEATOR POST

This invention relates to non-metal traffic delineator post of the type used along the sides of highways and carrying reflective material to mark the location of the highway. U.S. Pat. No. 4,092,081 discloses a traffic delineator post of this type having a specialized fiberglass body.

The traffic delineator post of this invention includes a body having a non-uniform thickness transverse cross-section along its length with uniform thickness flex sections located a distance above grade and a short distance below the bottom of reflective material carried at the top of the post. The lower flex section permits non-destructive bending down of the post when hit by a vehicle so that the post snaps up to the vertical position after the hit and the reflective material is repositioned in its work location without the necessity of repairing the post. The upper flex section is provided to permit controlled bending of the post at the flex section for replacement of the reflective material carried by the post as required. In this way, it is possible to replace the reflective material of a driven part in the event the initially installed reflective material is injured.

During manufacture of the post the reflective material is inserted into edge slots inside lips from the top of the post. A cap is then permanently attaching to the upper end of the post. The cap contains a lip extending across the top of the post and down over the upper edge of the reflective material so that the top and sides of the reflective material are confined in a U-shaped slot and are sealed against water and other foreign matter. This is particularly important in environments where the post is subjected to freezing rain and snow.

The post includes a uniform thickness strip extending across the full width with integral projections which increase the thickness of the post and provide desirable stiffening so that the post is self-supporting following driving into the ground. These projections are cut away at the flex sections to promote the desired and controlled non-destructive flexing of the post.

In one embodiment the post strip is curved in transverse section to provide additional strengthening. When this post is hit by a vehicle it is believed that the curved strip portion of the strip at the lower flex section is first flattened and then bent in the direction of impact. After the vehicle has past and the impact forces are removed the post flexes back to the vertical and the strip resumes its curved shape.

In other embodiments of the invention the strip is flat and is provided with strengthening lips at its edges. These lips also define the side slots for retaining the reflective material at the upper end of the post. One post using a flat strip is provided with reflective material on one side of the strip only and includes an additional strengthening rib at the center of the other side of the strip. In another embodiment the post includes reflective sheets on both sides of the strip with strengthening edge lips increasing the thickness of the post at both sides of the strip. The increased thickness rib and lips are cut away at the weakened flex sections.

Other objects and features of the invention will become apparent as the description proceeds, especially when taken in conjunction with the accompanying drawings illustrating the invention, of which there is one sheet.

Figures 1, 2, 3, 4, 5, 6, 7, 8:
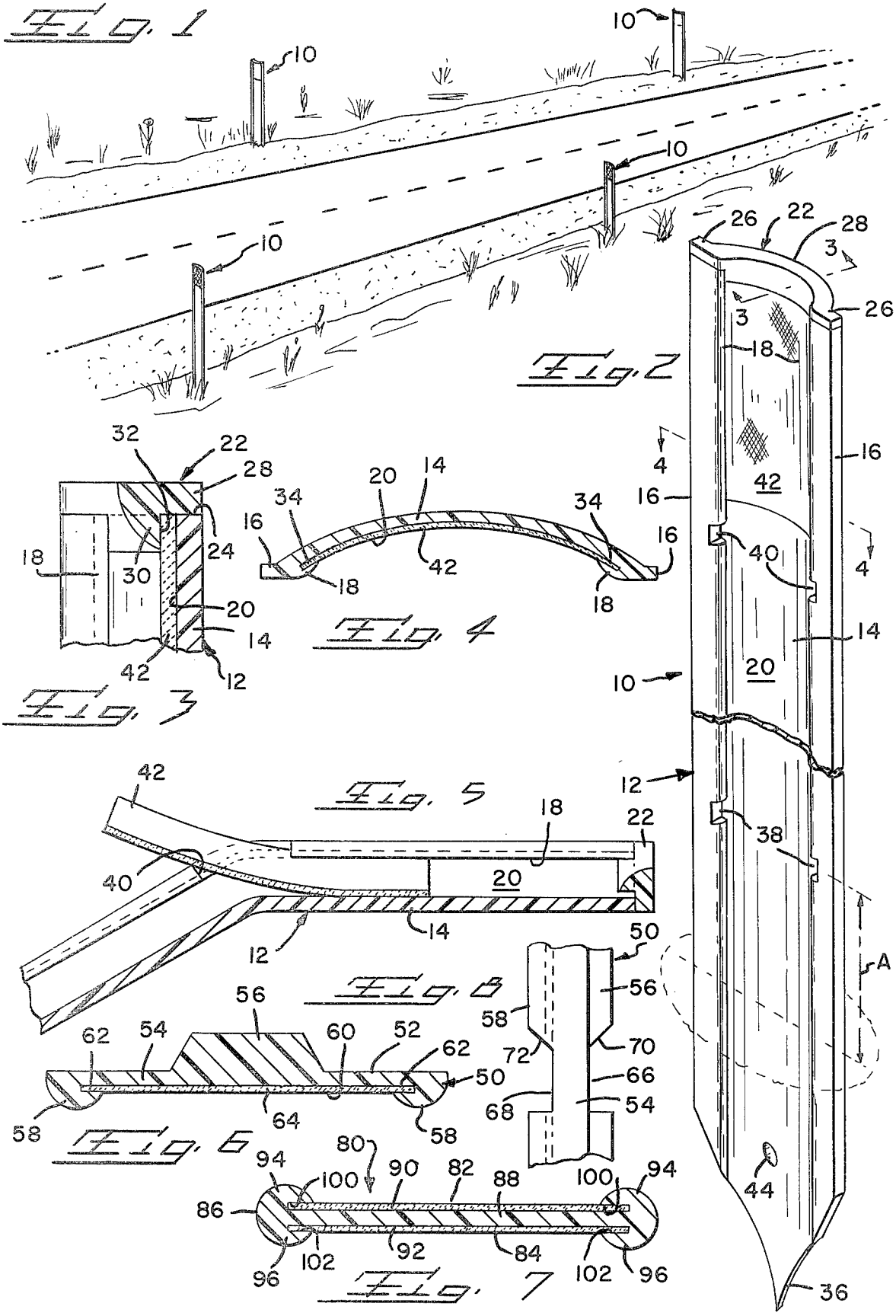
FIG. 1 is a perspective view of a highway showing traffic delineator posts according to the invention mounted on both sides of the highway to mark the highway and reflect back lights from oncoming traffic.
FIG. 2 is a perspective view, partially broken away, of a traffic delineator post according to the invention.

FIGS. 3 and 4 are sectional views taken, respectively, along lines 3—3 and 4—4 of FIG. 2;

FIG. 5 is a longitudinal sectional view taken along line 3—3 of FIG. 2 but illustrating the top of the post bent for replacement of the reflective sheet;

FIGS. 6 and 7 are similar to FIG. 4 but illustrate different embodiments of the invention; and FIG. 8 is a side view of the post of FIG. 6 illustrating a flex section.

Traffic delineator post 10 includes an elongate stiffly flexible body 12 preferably formed from a fiberglass or plastic material. When formed of fiberglass material, the body includes longitudinally extending strengthening fibers bonded together in a thermoplastic resin binder. The body may also be formed from plastic such as high density polyethylene.

The body 12 is preferably formed from a length of stock material having a uniform cross section. This material may be manufactured by an extrusion operation. As illustrated in FIGS. 2 and 4, body 12 includes a longitudinally extending curved uniform thickness strip 14 having a wing 16 on each outer edge thereof and a pair of lips 18 extend inwardly from the edges of the strip 14 and spaced a short distance away from the concave interior surface 20 of the strip. Surface 20 is preferably semi-cylindrical in shape in order to improve the reflection of light directed against the post as described hereinafter.

Post 10 includes a cap 22 preferably molded from plastic material which fits flush over the upper end 24 of body 12. The cap includes a pair of wings 26 on the ends thereof and a curved central portion 28 which overlies the top 24 of the strip 14. The cap line 30 extends downwardly of the central portion 28 and is spaced a distance apart from surface 20 to define a slot or recess 32 extending across the top of the strip 14. Recess 32 is continuous with the slots or recesses 34 between surface 20 and the interior surfaces of lips 18 at the sides of the strip to fine a continuous U-shaped recess at the upper end of the post 10.

A point 36 is formed on the lower end of body 12 to facilitate driving the post into the ground adjacent the roadway. A pair of flex notches 38 formed through post lips 18 define a lower flex section located on the post a distance of approximately 12 inches above grade. A second pair of flex notches 40 define an upper flex section formed through lips 18 a short distance below the top of the post.

During manufacture of post 10 a sheet of flexible reflective material 42 is bent to conform to the shape of surface 20 and is then inserted down past a top end 24 of the post in the recesses 34. When the top of the sheet is flush with the top of body 12 the bottom of the sheet is located slightly above the flex notches 40 as illustrated in FIG. 2. The sheet 42 has a sufficient width to fully fill the recesses 34 as shown in FIG. 4. Cap 22 is then placed on the upper end 24 of the post and is permanently bonded to the post, preferably by a glue or adhesive at the interface between the body strip and wings and cap central portion and wings. When in this position, the cap lip 30 overlies the upper end of the strip 42 so that the strip is confined in place at the upper end of the post and extends into the U-shaped recess 34, 32, 34.

As illustrated in FIG. 1, post 10 is driven into the ground alongside a roadway with the reflective material 42 at the top of the post facing oncoming traffic. Headlight beams directed against the post hit the material and reflect back to the driver. In this way, the post serves to delineate the side of the road. The horizontal curvature of the reflective material as determined by the single curvature cylindrical surface 20 facilitates back reflection of light even if the incident light is not perpendicular to the post.

The post may be driven directly into the ground by means of a conventional impact driver of the type used to drive fence posts. In some applications, where the ground is rocky, it may be necessary to provide steadying means within the impact driver to prevent buckling of the post during driving. As previously mentioned, when the post is driven in place to reflect back light the flex notches 38 are located a distance A of approximately 12 inches above grade. Post 10 may have a width of about three inches and extends approximately 48 inches above grade to be readily visible to oncoming traffic. When it is difficult to secure the post in the ground it may be necessary to drive a separate mounting anchor diagonally into the ground and through post anchor hole 44 formed through the strip 14 at a location below grade level. The anchor may be of a conventional type and extends to either side of the post thereby increasing the force required to withdraw the post from the ground.

At notches 38 and 40 the post has a uniform cross-sectional thickness from one side to the other side. The notches provide a weakened single thickness flex portion approximately twelve inches above grade such that when the post is hit by a vehicle above the notch the post is non-destructively bent down about the lower flex section and then pops up with minimum damage after the vehicle is past. In tests, the post has returned to the vertical after three impacts of the vehicle travelling at 50 m.p.h. It is believed that the force of the impact momentarily flattens the curved strip 14 at the flex section to permit the flexing of the post beneath the vehicle. The notches assure that the flex area has a single thickness without protruding extra thickness portions such as the lips, which would be subjected to shear forces upon impact by a vehicle. Shear forces tend to sever the projecting portions from the uniform thickness portion.

The driven post 10 stands upright from the ground to hold the reflective sheet 42 in position to reflect back headlight beams directed upon it. The curved strip 14 and outstanding wings 16 provide sufficient rigidity to the post to hold it in its vertical position despite the usual low impact forces encountered at roadside. The plastic or fiberglass construction of the body 12 and plastic construction of cap 22 assure that the post is durable and does not deteriorate when exposed to changing weather conditions.

Sometimes after the post 10 has been in use for a period of time it is necessary to replace the reflective sheet 42. The cap 28 is permanently attached to the top of the post and prevents removal of the sheet from the post. The sheet 42 may be removed by bending back the top of the driven post as shown in FIG. 5 so that the upper flex section defined by notches 40 is on the outside surface of the bend. In practice, the bend may extend along a greater length of the post than shown in FIG. 5. This bending of the post tends to flatten the curved body 14 and, with flattening, provides clearance between the edges of sheet 42 and recesses 34 thus freeing the sheet to be slid away from cap 28 and out the notches 40 as illustrated. A replacement sheet of reflective material may then be flexed and slid into the upper end of the post until it is fully seated in the U-shaped recess defined by recesses 34, 32 and 34. Flattening of curved body 14 facilitates insertion of the new sheet of reflective material. When the sheet is fully seated the post is released to return to is upright position of FIG. 2 and the new sheet is firmly locked into position in the two side recesses 34. If desired, a specialized tool may be used to bend the top of the post at the flex section defined by notches 40. In this manner, reflective sheets are easily and inexpensively replaced on previously driven posts. The notches 40 are located at a height above grade higher than the normal impact height with which a vehicle hits the post and for this reason, did not interfere with the impact bending of the post about the single thickness portion at the lower flex section 38. The notches 38 and 40 may have a longitudinal length of approximately ½ inch.

FIGS. 6 and 8 illustrate a traffic delineator post 50 similar to post 10 having a body 52 formed of a stiffly flexible weather resistant material such as fiberglass or high density polyethylene similar to body 12 of post 10. The body includes a flat elongate uniform thickness strip 54 having a stiffening rib 56 projecting from the rear surface and a pair of lips 58 extending along the edges of the body 52 and projecting outwardly of the flat front surface 60 thereof. The lips 58 overlie surface 60 to define a pair of edge slots or recesses 62 which extend the length of the body. Body 52 is preferably formed from by an extrusion operation with a uniform cross-section.

Post 50 is formed from a length of body material 52 and includes a pointed lower end, an upper end, and a cap on the upper end. The length of post 50 is same as the length of post 10. During manufacture of post 50 a sheet of reflective material 64 is inserted into recesses 62 of the upper end so that it extends across the entire width of surface 60. A cap like cap 22 of post 10, is then fitted over the top of post 50 and includes a lip projecting down past the top edge of the flat reflective sheet 64. The cap is bonded to the top of the post so that sheet is confined in place at the top of the post within a U-shaped recess extending along the edges of the post and across the top. Notch flex sections are provided in post 50 a short distance below the bottom of the reflective sheet 64 and at a distance above grade of approximately 12 inches. These flex sections are comparable to the flex sections of post 10.

FIG. 8 is a side view of the post 60 at one of the notch sections and illustrates a cutout notch 66 formed through the stiffening rib 56 and a cutout notch 68 formed through the lips 58. Notches 66 and 68 reduce the thickness of the post at the flex sections to the uniform thickness of the flat body 52 to allow the post to be flexed as described in connection with post 10. Both of these notches 66 and 68 have bevelled upper surfaces 70 and 72. These bevelled surfaces gradually increase the thickness of the post at the rib and lips above the flex areas to distribute bending stresses and decrease the possiblity that upon bending of the post the rib and lips are subjected to sufficient forces to shear away from the post at the junctions with the flat relatively flexible strip 54.

The upper flex notches are located below the reflective sheeting 64 to permit bending of the post about the notches for removal of the originally installed sheeting and insertion of replacement sheeting.

Traffic delineator post 50 is driven into the roadway beside a highway in the same manner as post 10. During normal use the rib 56 and lips 58 provide sufficient stiffening to the post to prevent undesired collapse or bending. The reflective sheeting 54 is sealed in the upper U-shaped recess of the post and is protected against weather by the cap and lips 58.

FIG. 7 is a cross-sectional view of the two-sided traffic delineator post 80 similar to post 50 but with sheets of reflecting material 82 and 84 on opposite sides of the post. The post 80 includes an elongate body 86 formed from stock material similar to material used to form bodies 12 and 52. The stock material used to form body 86 has a uniform transverse cross-section along its length. The body includes a flat strip 88 extending across the width of the post. Strip 84 has a uniform thickness and defines a pair of flat surfaces 90 and 92 on the opposite sides of the post. Pairs of mounting lips 94 and 96 are provided on the opposite edges of the post to define recesses 100 and 102 which extend along the lateral edges of surfaces 90 and 92. During the manufacture of post 80 a point is formed at the lower end and the reflective sheets 82 and 84 are inserted into the recesses 100 and 102 at the upper ends of the post so that they overlie both sides of the strip 88. A suitable cap is then secured to the upper end of the post. The cap includes a pair of lips which overlie the upper edges of the reflective material similarly to the way in which lip 30 of cap 22 overlies the upper edge of reflective sheet 42 in post 10 and, in that way, hold the reflective sheets 82 and 84 in U-shaped recesses extending around three sides of the sheets.

The post 80 is provided with two flex sections, one located below the lower edge of the sheets 82 and 84 and the other located at a distance above grade of approximately 12 inches. At each of these sections the lips 94 and 96 are removed to reduce the thickness of the post to that of strip 88 and promote flexibility of the post. The upper shoulders of the flex areas may be tapered in a manner similar to that used in post 50.

The upper flex section of post 80 permits bending of the post to one side or the other side so that either of the reflective sheets 82 or 84 may be removed and replaced as desired. The lower flex area permits the post 80 to be flexed down to the ground when hit by an automobile in either direction without shattering or severe injury to the post. As in the previously described posts 10 and 50 the post 80 snaps back up to the upright position after being hit by a vehicle.

The post 80 is intended for use along highways where the location of the highway need be marked on both sides of the post. With this post headlight beams received from either direction are reflected back to mark the highway burm. During normal use the increased thickness lips 94 and 96 stiffen the post sufficiently to hold it upright so that the sheets of reflective material 82 and 84 are in a position to reflect back light.

While I have illustrated and described preferred embodiments of my invention, it is understood that they are capable of modification, and I therefore do not wish to be limited to the precise details set forth, but desire to avail myself of such changes and alterations as fall within the purview of the following claims.

What I claim is my invention:

1. A delineator post comprising a body made from a section of long thin flexible stock having a uniform transverse cross section, the body including a strip of essentially uniform thickness and lips at the edges of the strip projecting outwardly of one side of the strip to increase the thickness of the body; a light reflective member; a connection securing such member to the top end of the body on said one side of the strip, the lower end of the body being adapted to be buried below grade so that the post extends vertically upwardly and the light reflecting member is in position to reflect light directed thereon; and a first flex section of the post located above the lower end, such first flex section including notches extending through all portions of the body, including said lips, increasing the thickness of the body greater than the thickness of the strip so that the thickness of the post at the first flex section is essentially uniform across the width thereof, whereby a vehicle impacting the post above the flex section non-destructively bends the post down about such section, passes over the post and thereafter the post elastically returns to its upright position, the inner edges of the lips overlying said one side of the strip to define a pair of edge recesses extending along the length of the body, a lip on the top end of the body overlying said one side of the strip, such lip extending between the lips at the edges of the strip to define a recess extending across the top end of the body, the top recess and the edge recesses cooperating to define a generally U-shaped recess extending around the top end of the post; said light reflecting member comprising a flexible sheet of light reflective material lying flush on said side of the strip and having side edges and a top edge, such edges and said U-shaped recess forming said connection with the edges extending into the U-shaped recess to secure the light reflective member to the body; and a second flex section of the post located between the light reflective material and the first flex section, such second flex section including notches extending through all portions of the body, including said lips, increasing the thickness of the body greater than the thickness of the strip so that the thickness of the post at the second flex section is essentially uniform across the width thereof, whereby the upper end of the post may be bent back to open the notches of the second flex section to permit movement of the flexible sheet of light reflective material out of and into the U-shaped recess through the notches of the second flex section.

2. A delineator post as in claim 1 wherein said strip is flat and the strip includes a central longitudinally extending rib projecting from the other side thereof, such rib being cut away at both said flex sections.

3. A delineator post as in claim 1 wherein said strip is curved in cross section and the side edges of the sheet of light reflective material are tightly fitted within the edge recesses whereby upon bending back of the top of the upper end of the post the strip and light reflective material are flattened and clearance is provided between the edges of the light reflective material and the edge recesses.

4. A delineator post as in claim 1 wherein said strip and sheet of light reflective material are concavely curved in transverse cross section, the exposed surface of said sheet being concave.

5. A delineator post as in claim 4 wherein said body includes parallel wings on the edges thereof, said wings extending at an angle to the curved strip.

6. A delineator post as in claim 1 including a second pair of lips at the edges of the strip projecting outwardly of the other side of the strip to increase the thickness of the body, the inner edges of such second pair of lips overlying said other side of the strip to define a second pair of edge recesses extending along the length of the body; a second lip on the top end of the body overlying said other side of the strip and extending between the second pair of lips to define a recess extending across the top end of the body, such top recess and the second edge recesses cooperating to define a second generally U-shaped recess extending across the top end of the post; and a second flexible sheet of light reflective material lying flush on said other side of the strip having side edges and a top edge, such edges of such material extending into said second U-shaped recess to secure the second light reflective material to the post; and wherein both said flex sections include notches extending through both said pairs of lips.

7. A delineator post comprising a body made from a section of long, thick flexible stock having a uniform transverse cross section, the body including a strip of essentially uniform thickness, lips at the edges of the strip projecting outwardly of one side of the strip to increase the thickness of the body, the inner edges of the lips overlying one side of the strip to define a pair of edge recesses extending along the length of the body; a flexible sheet of light reflective material lying flush on said side of the strip and having side edges and a top edge, the side edges extending into said edge recesses to form a connection securing the light reflective member to the body; and a flex section of the post located below the light reflecting material, said flex section including notches extending through all portions of the body, including said lips, increasing the thickness of the body greater than the thickness of the strip so that the thickness of the post at the flex section is essentially uniform across the width thereof, whereby the upper end of the post may be bent back to open the notches of the flex section to permit movement of the flexible sheet of light reflective material out of and into edge recesses through the notches.

8. A delineator post as in clam 7 including means at the top end of the body overlying said one side of the strip, the top edge of the strip engaging said means as part of the connection between the light-reflecting material and the body.

9. A delineator post as in claim 8 including a lower end adapted to be buried to support the post and a second flex section like said first recited flex section located between such flex section and the lower end of the post to permit non-destructive bending of the post upon vehicle impact.

* * * * *